US008306448B2

(12) United States Patent
Claassen

(10) Patent No.: US 8,306,448 B2
(45) Date of Patent: Nov. 6, 2012

(54) FUSER SYSTEM AND HEAT SOURCE POWER CIRCUIT

(75) Inventor: Franciscus Gerardus Johannes Claassen, Oploo (NL)

(73) Assignee: Xerox Corporation, Norwalk, CT (US)

( * ) Notice: Subject to any disclaimer, the term of this patent is extended or adjusted under 35 U.S.C. 154(b) by 316 days.

(21) Appl. No.: 12/841,468

(22) Filed: Jul. 22, 2010

(65) Prior Publication Data

US 2012/0020695 A1 Jan. 26, 2012

(51) Int. Cl.
*G03G 15/00* (2006.01)
*G03G 15/20* (2006.01)

(52) U.S. Cl. ..... 399/88; 399/69

(58) Field of Classification Search ..... 399/88, 399/69; 219/216

See application file for complete search history.

(56) References Cited

U.S. PATENT DOCUMENTS

| | | | |
|---|---|---|---|
| 4,862,225 | A | 8/1989 | Heiller et al. |
| 5,749,038 | A | 5/1998 | Fromm et al. |
| 5,932,934 | A | 8/1999 | Hofstetter et al. |
| 6,002,913 | A | 12/1999 | Pawlik et al. |
| 6,373,232 | B1 * | 4/2002 | Mano et al. |
| 6,487,389 | B2 | 11/2002 | Jia et al. |
| 6,876,832 | B2 | 4/2005 | Pirwitz et al. |
| 7,412,196 | B2 | 8/2008 | Chen |
| 7,680,424 | B2 | 3/2010 | Hurst et al. |

* cited by examiner

*Primary Examiner* — Sophia S Chen
(74) *Attorney, Agent, or Firm* — Fay Sharpe LLP

(57) ABSTRACT

A printing system fuser is presented with an AC-AC power circuit using a pair of high speed pulse width modulated switches and low speed switching devices for flyback current conduction for powering a fuser heating element, and power factor control system and techniques are presented for adapting AC-AC converter control for powering one fuser heating element at least partially according to angle control switching of another fuser heating element to control fuser power factor.

21 Claims, 7 Drawing Sheets

FUSER SYSTEM AND HEAT SOURCE POWER CIRCUIT

BACKGROUND

Fusers are found in a variety of printers, copiers, etc. for adhering or fusing marking material such as ink, toner, etc. onto paper sheets or other printable media. The fusing process typically includes one or more fuse rollers that are heated using resistive or lamp-type heating elements. The fuser lamps are often powered by triac controlled circuits, which either run in a phase angle (angle control) or cycle stealing mode. The first method involves turning a triac switch on for only a portion of each AC input power half-cycle, but this type of switching generates harmonics and leads to poor power factor. The cycle stealing technique skips one or more input power cycles or half-cycles, and can cause lamp flicker problems. Full or half-bridge type AC-AC converters provide a pair of MOSFET or IGBT type switches in series where one is controlling the positive half cycle and the other the negative half cycle of the AC input power. Fast recovery power diodes are required for these AC-AC converters to accommodate the flyback current associated with switch turn-off, but such high speed diodes are costly and have high forward voltage levels, leading to high power loss and reduced efficiency. Accordingly, there is a need for improved fuser heating lamp system efficiency and power factor control in printing systems.

BRIEF DESCRIPTION

In accordance with one or more aspects of the disclosure, printing system fusers and heating element power circuits are provided, which include an AC-AC power conversion circuit to provide electrical power to a fuser heating element. The conversion circuit includes first and second rectifiers, which can be low speed diodes in certain embodiments, with a first rectifier between an AC power input and a first internal converter node, and a second rectifier between the input and a second internal node.

First and second high speed switching devices are provided, which can be high speed MOSFETs in certain embodiments. The high speed switching devices in various embodiments can be any suitable semiconductor-based switching devices controllable via one or more control signals, including without limitation bipolar transistors, field-effect transistors (FETs), isolated gate bipolar transistors (IGBTs), etc. The first high speed device is coupled between the first internal node and a third internal node, and the second high speed device is coupled between the second and third internal nodes. These high speed switching devices are alternatively turned on in complementary fashion in each cycle of a pulse width modulation period to provide current from the input to the heating element using one of the rectifiers.

Low speed switching devices are included to provide a conductive path for flyback current, with a first low speed device coupled between the heating element and the first internal node, and a second low speed device coupled between the heating element and the second internal node.

The low speed switching devices can be any suitable semiconductor-based switching devices operable by one or more control signals, including without limitation bipolar transistors, field-effect transistors (FETs), isolated gate bipolar transistors (IGBTs), etc. In certain embodiments, the low speed switching devices are low speed MOSFETs. One of the low speed switching devices is turned on in all or a portion of each half cycle of the AC input power to accommodate flyback current from output inductance of the converter.

In certain embodiments, moreover, a controller provides switching control signals to the low speed switching devices to turn one of them on in a first half cycle of the AC input power and to turn the other one on in the other half cycle. The controller also provides high speed pulse width modulated (PWM) switching control signals to alternatively turn the high speed switching devices on in complementary fashion in each cycle of a PWM period.

The new converter design may advantageously facilitate control of both high speed and low speed switches using standard high and low-side gate drivers, without requiring opto-couplers or pulse transformers, and thus provides a cost-effective solution. In addition, the power current is only flowing through a single low speed rectifier diode with low voltage drop and a single high speed switch (e.g., switch mode MOSFET), and thus the circuit consumes less power than previous AC-AC converter approaches to fuser heating element power circuits. In addition, the novel circuit can allow all control circuits to be referenced to a single common node, and thus measurement of lamp current and line voltage can be done without expensive current transducers or transformers.

In some embodiments, a second heating element is provided in the fuser, with an angle control switching device coupled to selectively allow or prevent input current flowing through the second heating element according to an angle control switching signal. The controller provides the angle control switching signal to selectively allow current to flow from the AC power source to the second heating element in at least a portion of the AC input half cycles to control the amount of power delivered to the second heating element. The controller, moreover, selectively adapts the high and low speed switching control signals for the AC-AC converter based in whole or in part on the angle control switching signal to control the fuser power factor.

In accordance with further aspects of the disclosure, a fuser is provided which includes multiple heating elements operative to heat at least a portion of one or more fuse rollers, with one of the heating elements being powered using an angle control switching device, such as a triac in certain embodiments. A controller provides an angle control signal to the angle control switching device to selectively allow current to flow from an AC power source to the first heating element in at least a portion of one or both half cycles of the AC input power to control the power delivered to the first elements. The fuser also includes an AC-AC power converter powering a second heating element, and the controller provides a switching control signal to the AC-AC converter to selectively allow current to flow from the AC power source to the second heating element, where the controller selectively adapts the switching control signal based at least partially on the angle control switching signal to control the fuser power factor.

In certain embodiments, the AC-AC circuit includes one or more high speed switching devices, such as IGBTs or high speed MOSFETs, operable according to high speed switching control signals to control the provision of power to the second heating element, and the controller provides PWM switching control signal(s) at least partially according to the angle control switching signal.

In accordance with still other aspects of the disclosure, a method is provided for operating a print system fuser. An angle control switching signal is provided to an angle control switching device to selectively allow current to flow from an AC power source to a first fuser heating element in at least a portion of one or both half cycles of AC input power so as to control an amount of power delivered to a first fuser heating element. The method also includes providing a switching control signal to an AC-AC power conversion circuit to selectively allow current to flow from the AC power source to a second heating element to control an amount of power delivered to the second heating element, and selectively adapting the AC-AC switching control signal based at least partially on the angle control switching signal to control a power factor of the fuser. In certain embodiments, the switching control signal is provided as a PWM signal to control the amount of power delivered to the second heating element.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
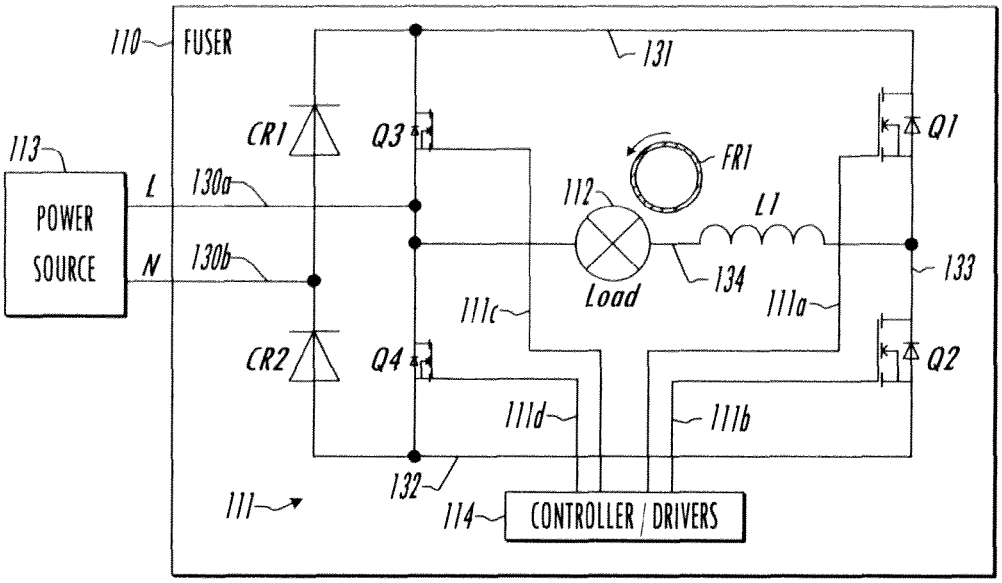
FIG. 1 is a schematic diagram illustrating an exemplary fuser heat source power circuit with a pulse width modulated high speed MOSFET-based AC-AC converter in accordance with one or more aspects of the present disclosure.
Figure 2:
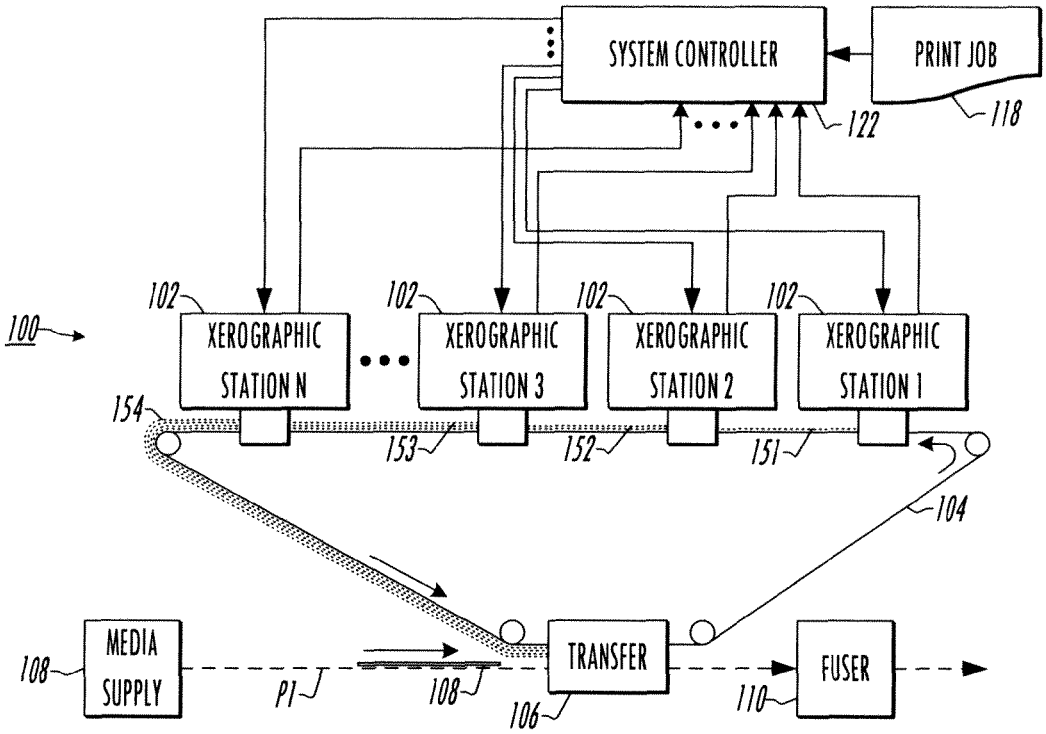
FIG. 2 is a simplified schematic system level diagram illustrating an exemplary multi-color document processing system with a fuser in accordance with the disclosure.
Figure 3:
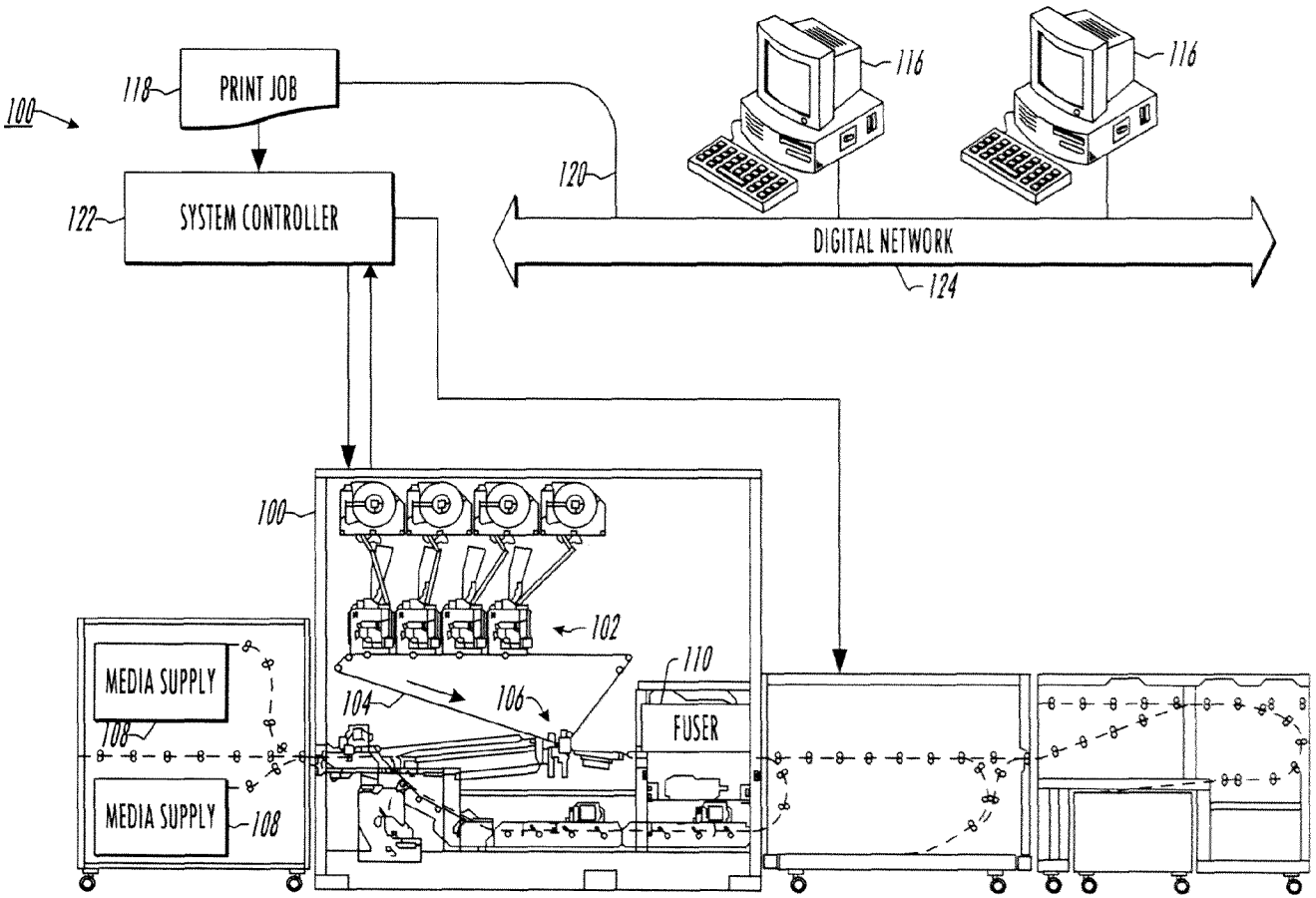
FIG. 3 is a detailed side elevation view illustrating an exemplary embodiment of the system of FIG. 2 in accordance with the disclosure.

Referring initially to FIGS. 1-3, FIG. 1 shows an exemplary fuser 110 with an AC-AC power conversion circuit 111 driving a lamp heat source for heating a fuse roller FR1, and FIGS. 2 and 3 illustrate printing systems 100 in which the fuser 110 may be used. The power circuit 111 provides a pulse width modulated high speed MOSFET-based AC-AC converter in accordance with one or more aspects of the present disclosure. The exemplary printing systems 100 in these embodiments utilize xerographic stations 102 to produce visible images according to input color data. The devices 100 further include a system controller 122 which provides input (e.g., C, M, Y, K) color data to the rendering system 102 according to a print job 118. The system 100 in FIG. 2 is a tandem multi-color document processing device with marking devices 102 individually operable according to control signals or data from the controller 122 to transfer toner marking material 151-154 onto an intermediate substrate 104 that may or may not be a photoreceptor, in this case, a shared intermediate transfer belt (ITB) 104 traveling in a counter clockwise direction in the figure past the xerographic marking devices 102 (also referred to as marking engines, marking elements, marking stations, etc.). In other embodiments, a cylindrical drum may be employed as an intermediate transfer substrate, with the marking devices 102 positioned around the periphery of the drum to selectively transfer marking material thereto. A transfer station 106 transfers the marking material 151-154 onto a printable medium 108 (sheet or continuous) travelling along a path P1 from a media supply 108, and the fuser 110 apparatus 110 fuses the transferred marking material on the printed media 108.

FIG. 3 shows an example in which four marking devices 102 are disposed along a shared or common intermediate transfer belt 104, along with a transfer station 106, a supply of final print media 108, and a fuser 110. In normal operation of the systems 100, print jobs 118 are received at the controller 122 via an internal source such as an in-line or outboard scanner (not shown) and/or from an external source, such as one or more computers 116 connected to the system 100 via one or more networks 124 and associated cabling 120, or from wireless sources. The print job execution may include printing selected text, line graphics, images, magnetic ink character recognition (MICR) notation, etc., on the front and/or back sides or pages of one or more sheets of paper or other printable media. In this regard, some sheets 108 may be left completely blank in accordance with a particular print job 118, and some sheets may have mixed color and black-and-white printing. Execution of the print job 118, moreover, may include collating the finished sheets 108 in a certain order, along with specified folding, stapling, punching holes into, or otherwise physically manipulating or binding the sheets 108. In certain embodiments the systems 100 may be stand-alone printers or may be a cluster of networked or otherwise logically interconnected printers, with each printer having its own associated print media source 108 and finishing components including a plurality of final media destinations, print consumable supply systems and other suitable components. Alternatively the system may include multiple marking engines 102 with a common media supply 108 and common finishers that are configured either serially or in parallel (separate parallel paper paths between feeding and finishing).

Figure 11:
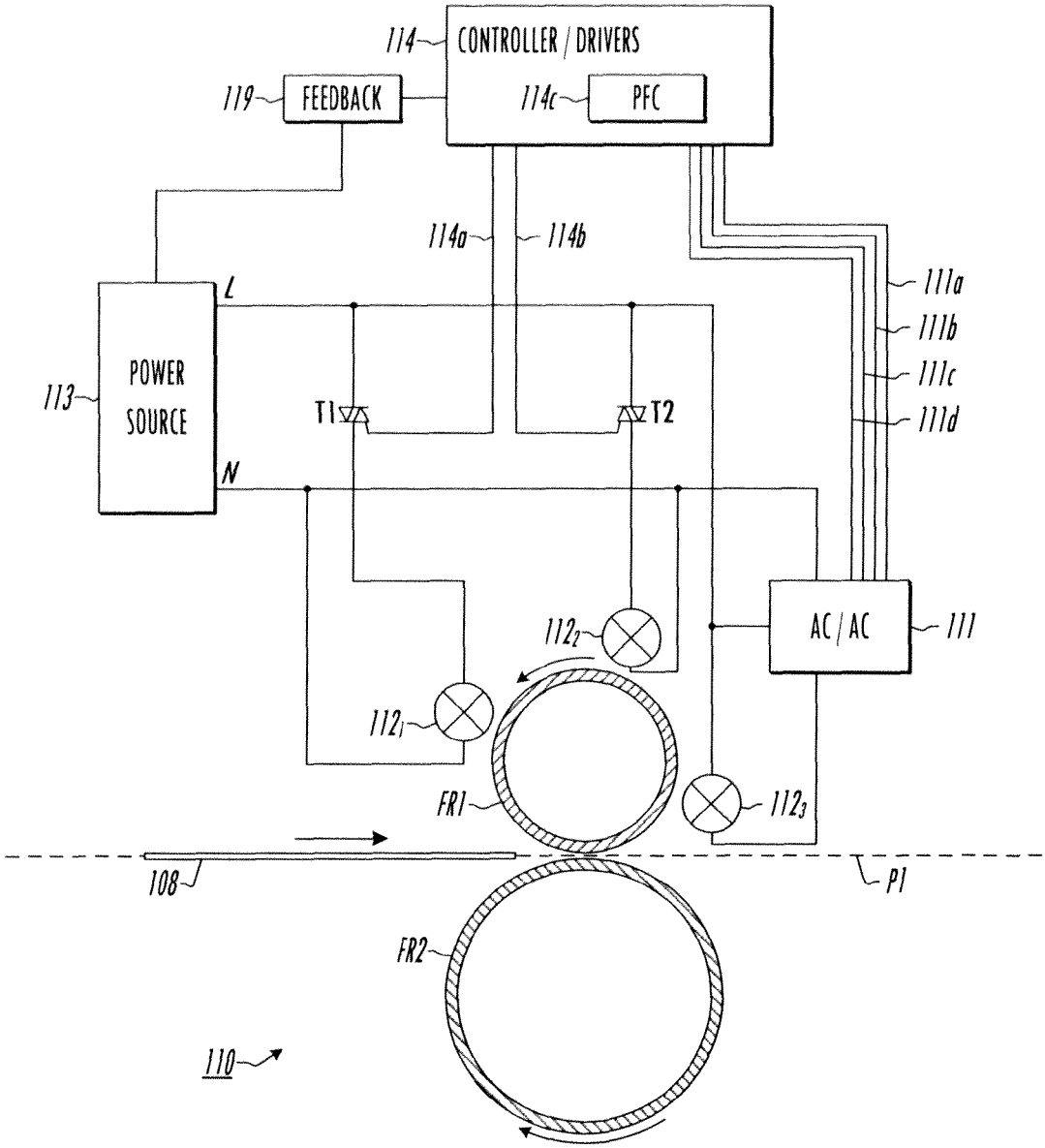
FIGS. 11 and 12 are partial side elevation and schematic diagrams illustrating power factor control for heating elements in a printing system fuser with switching control of an AC-AC converter driving one heating element adapted to compensate for angle control of another heating element.
Figure 12:
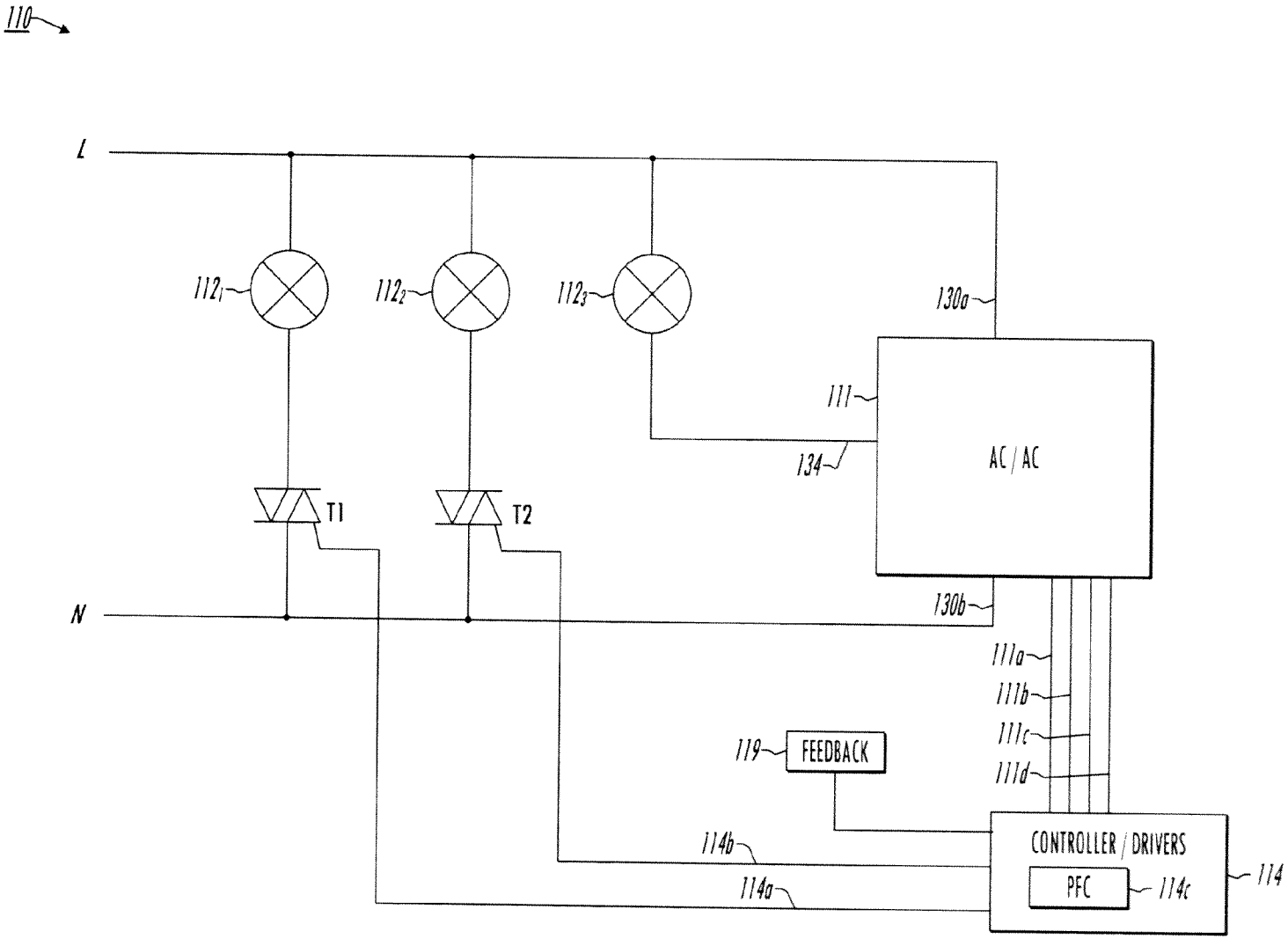

In operation, the fuser 110 employs one or more fuse rollers (e.g., roller FR1 in FIG. 1) to fuse marking material 151-154 (FIG. 2) onto a printable media 108 moving along a path P1 proximate the roller FR1, and a heating element (AC-AC converter load) 112 in FIG. 1 is powered by operation of an AC-AC power conversion circuit 111 in order to heat all or a portion of the fuse roller FR1. A given fuser 110 may employ multiple heating lamps 112 (e.g., as shown in the example of FIGS. 11 and 12 below), which may be of different sizes and/or shapes. Moreover, other forms of AC powered heating elements may be employed in certain embodiments, including but not limited to resistive heating elements.

The AC-AC power conversion circuit 111 shown in FIG. 1 provides AC electrical power to the heating element 112. The circuit 111 includes an input 130 with first and second input terminals 130*a* (line) and 130*b* (neutral) that receives AC input power from an AC power source 113. Although the illustrated embodiments use single phase AC input power, multi-phase inputs may be used in other embodiments. An output 134 is coupled with a first terminal of the heating element 112 and an inductance L1*h* is coupled in series with the heating element 112. The circuit 111 also includes first and second rectifiers CR1 and CR2, first and second high speed MOSFET type switching devices Q1 and Q2, as well as first and second low speed switching devices (e.g., MOSFETs) Q3 and Q4 in a circuit that includes first, second, and third internal nodes 131, 132, and 133, respectively.

In the illustrated example, the rectifiers CR1 and CR2 are low speed rectifiers, such as a KBJ25J 25 amp single phase bridge rectifier including both CR1 and CR2, available from WTE power semiconductors. CR1 is coupled between the input and a first internal node 131 with an anode coupled with the second input node 130*b* and a cathode coupled to the first internal node 131, and CR2 is coupled between the input and a second internal node 132, with a cathode coupled to the second input node 130*b* and an anode coupled to the second internal node 132.

The high speed switching devices Q1 and Q2 may be any suitable high speed IGBTs or MOSFETs, with Q1 coupled between the first and a third internal nodes 131 and 133, respectively, and with Q2 coupled between the second and third internal nodes 132 and 133, respectively. In the illustrated examples, Q1 and Q2 are N-channel MOSFET devices, such as STW45NM50, available from ST Microelectronics. Q1 includes a first terminal (source/drain) coupled with the first internal node 131, a second (source/drain) terminal coupled with the third internal node 133, and a first high speed control terminal (gate) coupled to receive a first high speed switching control signal 111*a* from a controller circuit 114 to selectively electrically couple the first and third internal nodes accordingly. Q2 has a first terminal coupled with the third internal node 133, a second terminal coupled with the second internal node 132, and a second high speed control terminal (gate) receiving a second high speed switching control signal 111*b* from the controller 114 for selective coupling of the second and third internal nodes 132 and 133 with one another.

The first and second low speed switching devices Q3 and Q4 in this embodiment are MOSFET devices, such as STP20NM50, N-channel, 500V, 20 amp transistors, where Q3 is coupled between the heating element 112 and the first internal node 131, and Q4 is coupled between the heating element 112 and the second internal node 132. As shown in FIG. 1, Q3 has a first source/drain terminal coupled with the first internal node 131, a second source/drain coupled with the first input node 130*a*, and a first low speed control terminal (gate) coupled to receive a first low speed switching control signal 111*c* from the controller 114 to selectively electrically couple the first internal node 131 with the first input node 130*a*. Q4 includes a first source/drain terminal coupled with the first input node 130*a*, a second source/drain terminal coupled with the second internal node 132, and a second low speed control terminal (gate) coupled to receive a second low speed switching control signal 111*d* from the controller 114 to selectively electrically couple the first input node 130*a* with the second internal node 132 accordingly.

The controller 114 can be any suitable hardware, processor-executed software, programmable logic, or combinations thereof, and includes driver circuitry for providing the signals 111*a*-111*d* at suitable current and voltage levels for actuating the switching devices Q1-Q4 as described herein. In this regard, the illustrated design allows operation without expensive isolation driver components such as pulse transformers, opto-couplers, etc., although the controller/driver circuit 114 may includes such components in certain embodiments. In certain embodiments, the controller 114 of the fuser 110 includes a microprocessor or microcontroller along with suitable memory for storing program instructions and/or data.

Referring also to FIGS. 4-10, in operation, the controller 114 provides the low speed switching control signals 111*c* and 111*d* to turn one of the low speed switching devices on (e.g., Q3) in a first half cycle of the AC input power (e.g., when the line "L" is at a higher potential than the neutral "N"), and to turn the other one (e.g., Q4) on in a second half cycle of the AC input power. In addition, the exemplary controller 114 provides complementary pulse width modulated (PWM) high speed switching control signals 111*a* and 111*b* to alternatively turn the high speed switching devices Q1 and Q2 on and off in each cycle of the pulse width modulation period TPWM. This controlled operation of the converter 111 provides current from the input to the heating element 112 using CR1 or CR2 when a primary drive transistor Q1 or Q2 is on, and one of the low speed switching devices Q3 or Q4 is turned on in at least a portion of each half cycle of the AC input power to provide a conductive path to conduct flyback current from the inductance L.

Figure 4:
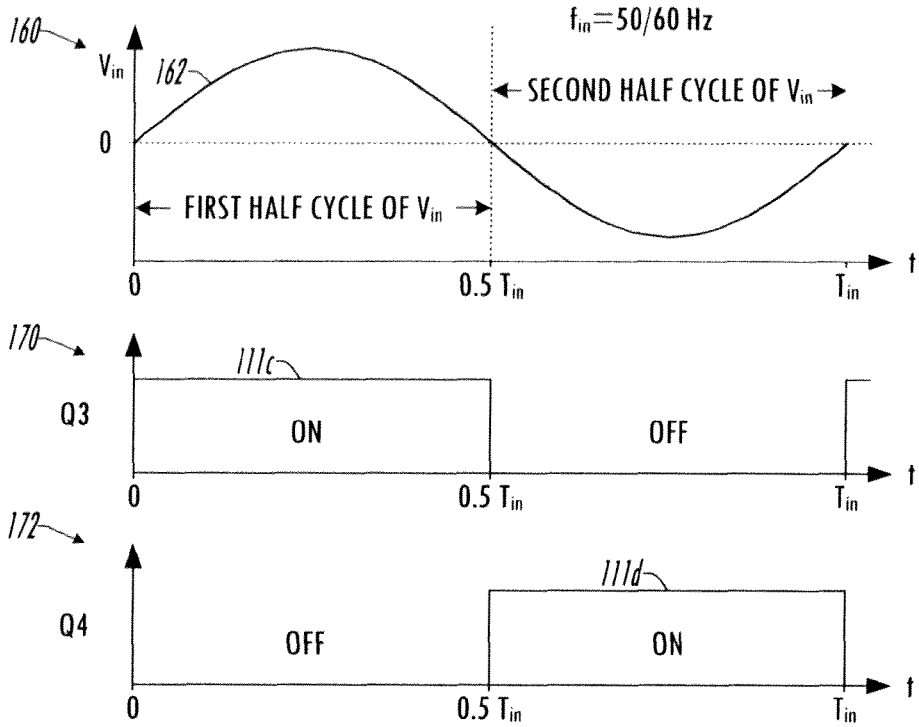
FIG. 4 Illustrates curves showing exemplary low speed MOSFET control signaling curves for flyback current conduction during two AC input power half cycles in the AC-AC converter of FIG. 1.

As seen in FIG. 4, a graph 160 shows an exemplary single full cycle of AC input power ($V_{in}$ 162) from the supply 113 (FIG. 1) for a case of input line frequency of 50 or 60 Hz. The various concepts of the present disclosure may be employed in connection with power sources 113 of any line frequency and amplitude, whether single or multiple-phase. The input line frequency establishes an input cycle period $T_{in}$ as shown in FIG. 4, and the controller 114 includes suitable zero-crossing detection circuitry (not shown) to determine the line input voltage or current zero crossings (e.g., at 0.5 $T_{in}$ and at $T_{in}$) and operates the low speed switching device control signals 111*c* and 111*d* accordingly, as shown in graphs 170 and 172, respectively. Thus, when $V_{in}$ is positive in the first half cycle (from t=0 to t=0.5 $T_{in}$), the first low speed transistor Q3 is on (conductive) and Q4 is off, and when $V_{in}$ is negative in the second half cycle of the input power (from t=0.5 $T_{in}$ to t=$T_{in}$), the first low speed transistor Q3 is off and Q4 is on.

Figure 5:
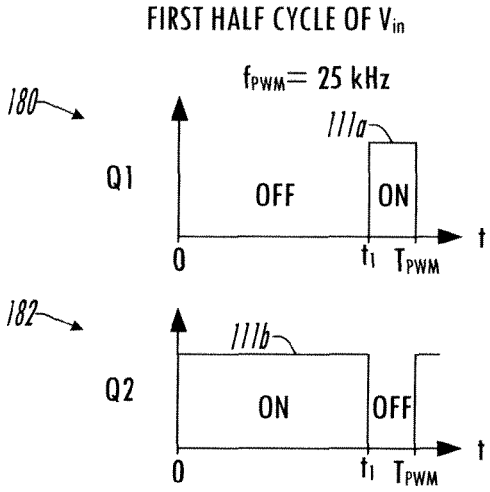
FIG. 5 illustrates pulse width modulation controlled switching of two high speed MOSFETs in the AC-AC converter of FIG. 1 for an exemplary pulse width modulation period in a first half cycle of the AC input power.
Figure 7:
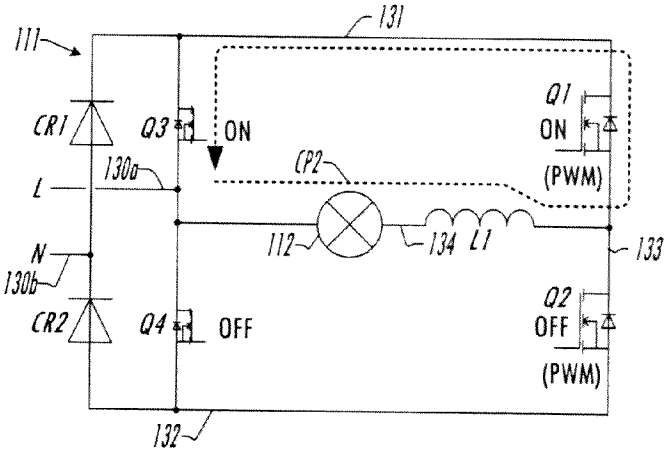
FIG. 7 is a partial schematic diagram illustrating current flow along a first current path with a PWM power switch on in the AC-AC converter of FIG. 1 in a first half cycle of the AC input power.
Figure 8:
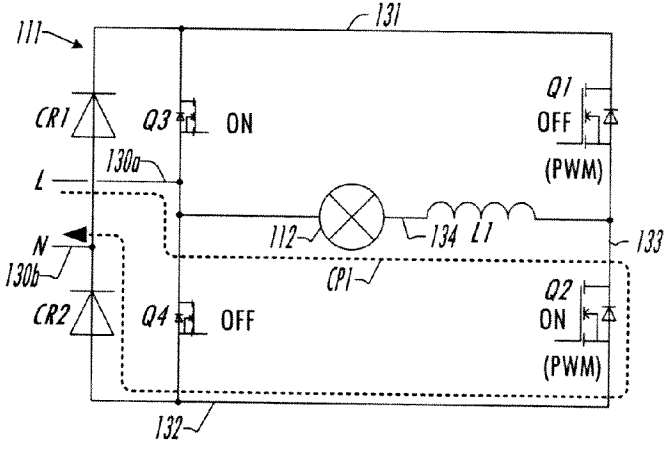
FIG. 8 is a partial schematic diagram illustrating flyback current flow along a second current path with the PWM power switch off in the first half cycle of the AC input power.

As shown in FIGS. 5, 7, and 8, the controller 114 provides high speed pulse width modulation of the high speed devices Q1 and Q2, for example, using a PWM frequency $f_{PWM}$ of about 25 kHz (PWM period $T_{PWM}$ of about 40 psec) in one embodiment. During the first half cycle of the input voltage in graphs 180 and 182 of FIG. 5, the controller 114 provides PWM switching signals 111*a* and 111*b* to Q1 and Q2, respectively, with Q2 being the primary load power switch with an on-time via signal 111*b* from t=0 to t=$t_1$ (during which time Q1 is off via signal 111*a*). This situation is shown in FIG. 7 in which Q2 and Q3 are on to provide a load driving current path CP1 from the line input terminal 130*a* through the heating element load 112, the output inductor L1 to the third internal node 133 and then through the high speed MOSFET Q2 and returning to the neutral terminal 130*b* via the second rectifier diode CR2. These switching states are then reversed for the remainder of the PWM period $T_{PWM}$ (Q1 on and Q2 off from $t_1$ to $T_{PWM}$), with FIG. 8 showing a resulting conductive current path CP2 for conduction of flyback current through the heating element 112, the inductor L1, Q1, and the low speed MOSFET Q3. This switching pattern repeats for any number of PWM cycles while the input power is in the first half-cycle (the PWM period $T_{PWM}$ is much shorter than the input power period).

Figure 6:
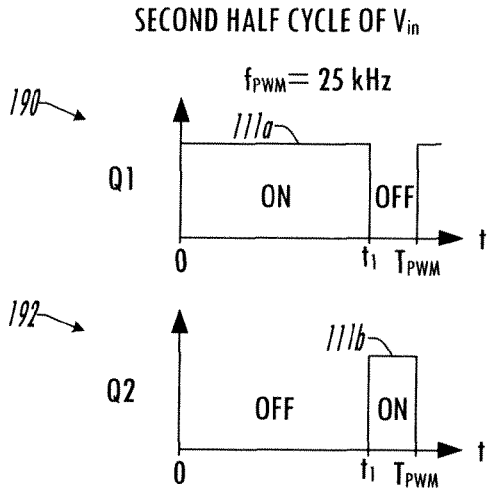
FIG. 6 illustrates high speed pulse width modulation controlled switching in the AC-AC converter in a second half cycle of the AC input power.
Figure 9:
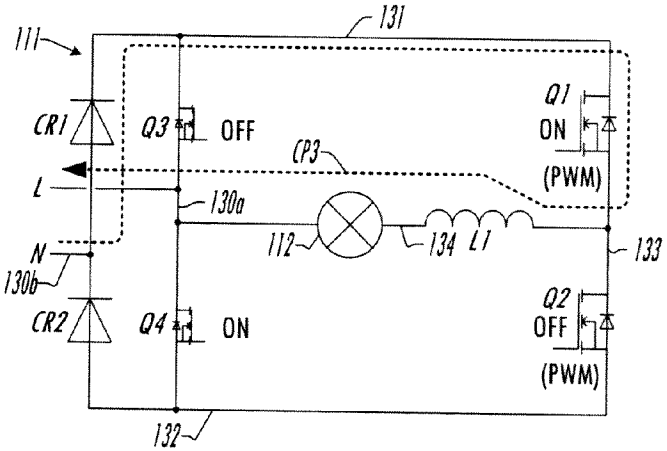
FIG. 9 is a partial schematic diagram illustrating current flow along a third current path with the other PWM power switch on in a second half cycle of the AC input power.
Figure 10:
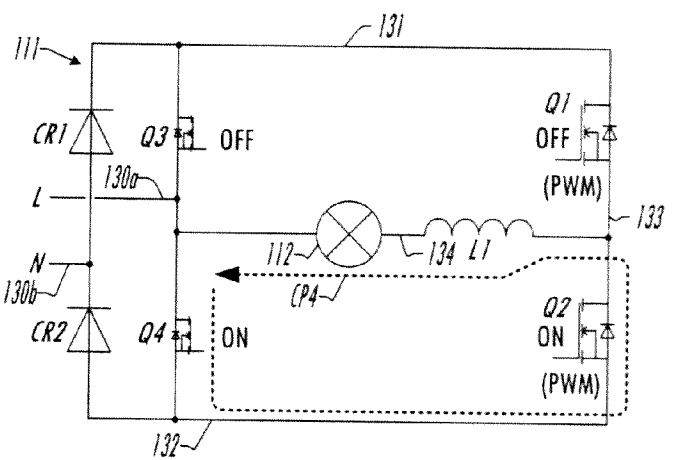
FIG. 10 is a partial schematic diagram illustrating flyback current flow along a fourth current path with the other PWM power switch off in the second half cycle of the AC input power.

Referring now to FIGS. 4, 6, 9, and 10, in the second half-cycle of the AC input power (from t=0.5 $T_{in}$ through t=$T_{in}$ in graph 160 of FIG. 4), the controller 114 turns Q3 off and turns Q4 on (per signals 111*c* and 111*d* as shown in FIG. 4. Graphs 190 and 192 in FIG. 6 show the high speed switching control signals 111*a* and 111*b* provided by the controller 114 to Q1 and Q2, with Q1 now being the primary load power switch with an on-time from t=0 to t=$t_1$ (during which time Q2 is off via signal 111*b*). As shown in FIG. 9, during this period, Q1 is on to provide a load driving current path CP3 from the neutral input terminal 130*b* through first rectifier CR1, Q1, the inductor L1, and the heating element 112, returning to the line terminal 130*a*. As shown in FIG. 10, from t1 to $T_{PWM}$ in FIG. 6, the Q1 and Q2 switching states are reversed (Q2 on and Q1 off) to provide a conductive current path CP4 for flyback current to flow through Q4, Q2, L1, and the heating element 112, and the high speed PWM switching pattern repeats for any number of PWM cycles while the input power is in the second AC input half-cycle.

Referring also to FIGS. 11-15, the fuser 110 may include multiple lamps or resistive heating elements 112 for heating at least one of two fuser rollers FR1 and FR2. In the example of FIG. 11, the fuser 110 has a first lamp $\mathbf{112}_1$ powered by a first triac T1 for angle control using power from the power source 113, and a second triac controlled heating element $\mathbf{112}_2$ phase controlled by triac T2. The controller 114 in this case provides angle control switching signals 114*a* and 114*b* to the triacs T1 and T2, respectively. The fuser 110 also includes a third heating element $\mathbf{112}_3$, driven by an AC-AC converter 111, which can be any conversion circuit that controls provision of AC power to the third heating element 1123 under control of one or more switching signals from the controller 114, such as the converter 111 shown in FIGS. 1 and 7-10 above receiving high and low speed switching control signals 111*a*-111*d*. In this embodiment, the controller provides the triac control signals 114*a* and 114*b* to provide a desired amount of power to the first and second heating elements $\mathbf{112}_1$ and $\mathbf{112}_2$ (for example, using angle control with a turn on delay in each half-cycle of the AC input power according to performance driven setpoint heat values for each of these two lamps).

Figure 13:
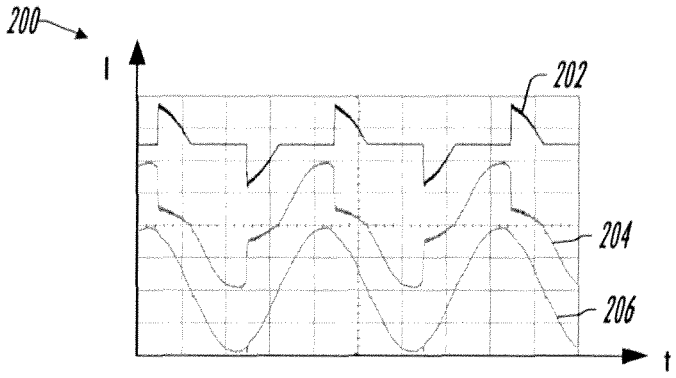
FIGS. 13-15 are graphs showing exemplary adaptation at three different line voltage levels for power factor control in the fuser of FIGS. 11 and 12.
Figure 14:
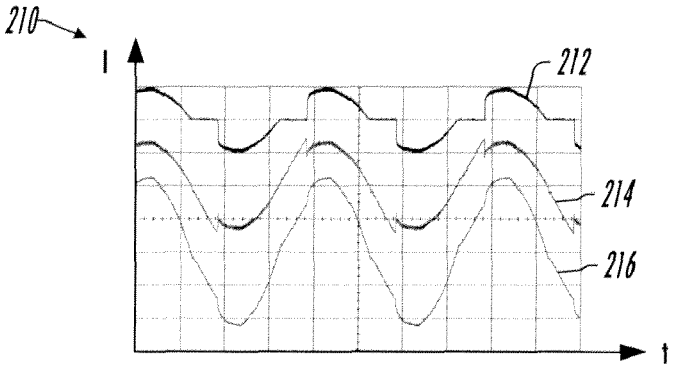
Figure 15:
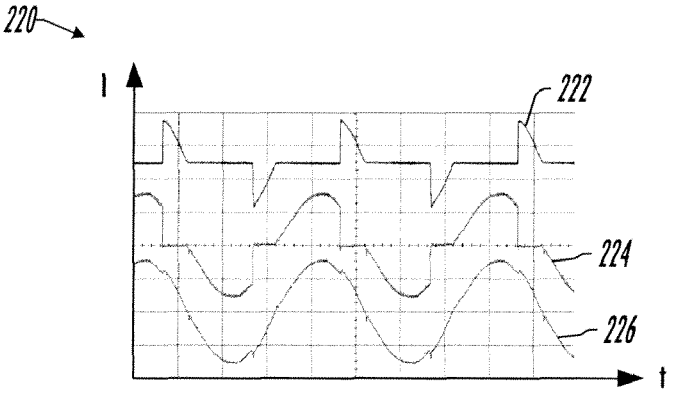

In addition, the controller 114 in this embodiment includes a power factor correction or power factor compensation (PFC) component 114*c* that selectively adapts the high and low speed switching control signals 111*a*-111*d* based at least partially on the angle control switching signal 114*b* to control a power factor of the fuser 110. Graphs 200, 210, and 220 in FIGS. 13-15 show exemplary PFC adaptation at three different line voltage levels for power factor control in the fuser 110 of FIGS. 11 and 12. Graph 200 in FIG. 13 shows a curve 202 for the current of the second lamp $\mathbf{112}_2$ in which the triac T2 is turned on a controlled amount of time following each input power zero crossing (triac T1 is controlled in substantially the same way in these examples). As previously noted, this angle control form of AC power control can cause harmonics and lead to non-unity power factor for the fuser 110. In order to counteract these adverse effects, the controller 114 adapts the control of the AC-AC converter 111 to controls the lamp current through load $\mathbf{112}_3$ via the high and low speed switching control signals 111*a*-111*d* in order to render the overall current drawn by the fuser heater power system essentially or substantially sinusoidal, as shown by the curve 206 in FIG. 13.

The adaptation of the AC-AC converter control, moreover, is used by the controller 114, in conjunction with input voltage and/or current feedback information from a feedback circuit or system 119 (FIGS. 11 and 12) to control the overall fuser heating system power factor. In certain embodiments, for instance, the controller 114 determines the triac turn-on times and uses the switching control signals 111*a*-111*d* of the AC-AC converter to cause the converter 111 to consume more input current while the triacs T1, T2 are off, and then to consume less current when the triacs T1, T2 are on, so as to provide an essentially sinusoidal current draw in phase with the input voltage as shown in curve 206. In this regard, the feedback system 119 can obtain, and the controller 114 can use, sensed lamp current and/or voltage information in adapting the control of the AC-AC converter 111 for harmonic control and/or for power factor control purposes.

The graph 200 in FIG. 13 shows current waveforms 202, 204 and 206 for the case with a 120 VRMS line input from the source 113 in a typical fuser warm-up situation where two lamps (e.g., lamps $\mathbf{112}_2$ and $\mathbf{112}_3$) are powered, with lamp $\mathbf{112}_3$ set to 975 W and lamp $\mathbf{112}_2$ set to 525 W. In order to make the total line current sinusoidal as shown in the curve 206, the AC-AC converter 111 is controlled with a high PWM level at the beginning of the half-cycles. Once the triac T2 turns on, the PWM control level for the converter 111 is reduced by the controller 114 via adjustment or adaptation of the corresponding switching control signals 111*a*-111*d*. In this regard, the adaptation may be done exclusively through adjustment of the switching signals 111*a* and 111*b* since the low speed switching control signals 111*c* and 111*d* still operate to turn the low speed switching devices on in their respective half-cycles of the AC input power.

Referring also to FIGS. 14 and 15, different line voltages require other phase angle and PWM settings in order to maintain the same power levels. For instance, FIGS. 14 and 15 provide similar graphs 210 and 220 showing the current waveforms 212, 214, 216 and 222, 224, 226 at line voltages of 100V and 140V, respectively, where the lamp desired power levels are the same in all three examples.

The above described examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A fuser for a printing system, comprising:

at least one fuse roller operative to fuse marking material onto a printable media moving along a path proximate the at least one fuse roller;

a heating element operative to heat at least a portion of the at least one fuse roller; and an AC-AC power conversion circuit operative to provide electrical power to the heating element, the AC-AC power conversion circuit comprising:

an input receiving AC input power from an AC power source, an output coupled with a first terminal of the heating element, an inductance coupled in series with the heating element, first and second rectifiers, the first rectifier being coupled between the input and a first internal node, and the second rectifier being coupled between the input and a second internal node, first and second high speed switching devices, the first high speed switching device being coupled between the first internal node and a third internal node, and the second high speed switching device being coupled between the second and third internal nodes, the high speed switching devices being alternatively turned on in complementary fashion in each cycle of a pulse width modulation period to provide current from the input to the heating element using one of the rectifiers, and first and second low speed switching devices, the first low speed switching device being coupled between the heating element and the first internal node, and the second low speed switching device being coupled between the heating element and the second internal node, one of the low speed switching devices being turned on in at least a portion of each half cycle of the AC input power to provide a conductive path to conduct flyback current from the inductance.

2. The fuser of claim 1, comprising a controller operative to provide switching control signals to the low speed switching devices to turn one of the low speed switching devices on in a first half cycle of the AC input power and to turn the other one of the low speed switching devices on in a second half cycle of the AC input power, and to provide pulse width modulated high speed switching control signals to alternatively turn the high speed switching devices on in complementary fashion in each cycle of a pulse width modulation period.

3. The fuser of claim 2:

where the input comprises a first input node coupled with a first terminal of the heating element, and a second input node;

where the output is coupled with a second terminal of the heating element;

where the inductance is coupled between the third internal node and the output;

where the first rectifier includes an anode coupled with the second input node and a cathode coupled to the first internal node;

where the second rectifier includes a cathode coupled with the second input node and an anode coupled to the second internal node;

where the first high speed switching device includes a first terminal coupled with the first internal node, a second terminal coupled with the third internal node, and a first high speed control terminal coupled with the controller, the first high speed switching device being operative to selectively electrically couple the first and third internal nodes according to a first high speed switching control signal;

where the second high speed switching device includes a first terminal coupled with the third internal node, a second terminal coupled with the second internal node, and a second high speed control terminal coupled with the controller, the second high speed switching device being operative to selectively electrically couple the second and third internal nodes according to a second high speed switching control signal;

where the first low speed switching device includes a first terminal coupled with the first internal node, a second terminal coupled with the first input node, and a first low speed control terminal coupled with the controller, the first low speed switching device being operative to selectively electrically couple the first internal node with the first input node according to a first low speed switching control signal;

where the second low speed switching device includes a first terminal coupled with the first input node, a second terminal coupled with the second internal node, and a second low speed control terminal coupled with the controller, the second low speed switching device operative to selectively electrically couple the first input node with the second internal node according to a second low speed switching control signal; and where the controller is operative to provide the low speed switching control signals to turn one of the low speed switching devices on in a first half cycle of the AC input power and to turn the other one of the low speed switching devices on in a second half cycle of the AC input power, the controller operative to provide pulse width modulated high speed switching control signals to alternatively turn the high speed switching devices on in complementary fashion in each cycle of the pulse width modulation period.

4. The fuser of claim 3, where the first and second high speed switching devices are high speed MOSFETs.

5. The fuser of claim 4, where the first and second low speed switching devices are low speed MOSFETs.

6. The fuser of claim 5, where the first and second rectifiers are low speed rectifiers.

7. The fuser of claim 4, where the first and second rectifiers are low speed rectifiers.

8. The fuser of claim 3, where the first and second low speed switching devices are low speed MOSFETs.

9. The fuser of claim 3, where the first and second rectifiers are low speed rectifiers.

10. The fuser of claim 2, where the high speed and low speed switching devices are MOSFETs.

11. The fuser of claim 2, further comprising a second heating element with a first terminal coupled with the input; and an angle control switching device coupled to a second terminal of the second heating element and operative to selectively allow or prevent input current flowing through the second heating element according to an angle control switching signal;

where the controller is operative to provide the angle control switching signal to the angle control switching device to selectively allow current to flow from the AC power source to the second heating element in at least a portion of at least one of the half cycles of the AC input power to control an amount of power delivered to the second heating element; and where the controller selectively adapts the high and low speed switching control signals based at least partially on the angle control switching signal to control a power factor of the fuser.

12. The fuser of claim 1:

where the input comprises a first input node coupled with a first terminal of the heating element, and a second input node;

where the output is coupled with a second terminal of the heating element;

where the inductance is coupled between the third internal node and the output;

where the first rectifier includes an anode coupled with the second input node and a cathode coupled to the first internal node;

where the second rectifier includes a cathode coupled with the second input node and an anode coupled to the second internal node;

where the first high speed switching device is a high speed MOSFET with a first terminal coupled with the first internal node and a second terminal coupled with the third internal node;

where the second high speed switching device is a high speed MOSFET with a first terminal coupled with the third internal node and a second terminal coupled with the second internal node;

where the first low speed switching device is a low speed MOSFET with a first terminal coupled with the first internal node and a second terminal coupled with the first input node; and where the second low speed switching device is a low speed MOSFET with a first terminal coupled with the first input node and a second terminal coupled with the second internal node.

13. The fuser of claim 1, where the first and second low speed switching devices are low speed MOSFETs.

14. The fuser of claim, where the first and second rectifiers are low speed rectifiers.

15. The fuser of claim 1, where the first and second rectifiers are low speed rectifiers.

16. The fuser of claim 1, where the high speed switching devices are bipolar transistors, field-effect transistors, or isolated gate bipolar transistors.

17. The fuser of claim 1, where the low speed switching devices are bipolar transistors, field-effect transistors, or isolated gate bipolar transistors.

18. A fuser for a printing system, comprising:

at least one fuse roller operative to fuse marking material onto a printable media moving along a path proximate the at least one fuse roller;

a plurality of heating elements operative to heat at least a portion of the at least one fuse roller;

an angle control switching device coupled to a first one of the plurality of heating elements and operative to selectively allow or prevent input current flowing from an AC power source through the first one of the plurality of heating elements according to an angle control switching signal;

an AC-AC power conversion circuit operative to selectively provide electrical power from the AC power source to a second one of the plurality of heating elements according to at least one switching control signal; and a controller operative to provide the angle control switching signal to the angle control switching device to selectively allow current to flow from the AC power source to the first one of the plurality of heating elements in at least a portion of at least one of two half cycles of AC input power provided by the AC power source to control an amount of power delivered to the first one of the plurality of heating elements, the controller being operative to provide the at least one switching control signal to the AC-AC power conversion circuit to selectively allow current to flow from the AC power source to the second one of the plurality of heating elements, where the controller is operative to selectively adapt the at least one switching control signal based at least partially on the angle control switching signal to control a power factor of the fuser.

19. The fuser of claim 18, where the AC-AC power conversion circuit comprises at least one high speed switching device operable according to at least one high speed switching control signal to control provision of power from the AC power source to the second one of the plurality of heating elements, and where the controller is operative to provide the at least one switching control signal as a pulse width modulated high speed switching control signal to the at least one high speed switching device based at least partially on the angle control switching signal.

20. A method of operating a fuser of a printing system, the method comprising:

providing an angle control switching signal to an angle control switching device to selectively allow current to flow from an AC power source to a first heating element of a fuser in at least a portion of at least one of two half cycles of AC input power provided by the AC power source to control an amount of power delivered to the first heating element;

providing at least one switching control signal to an AC-AC power conversion circuit to selectively allow current to flow from the AC power source to a second heating element of the fuser to control an amount of power delivered to the second heating element; and selectively adapting the at least one switching control signal based at least partially on the angle control switching signal to control a power factor of the fuser.

21. The method of claim 20, where providing at least one switching control signal comprises providing the at least one switching control signal as a pulse width modulated switching control signal to control the amount of power delivered to the second heating element.

* * * * *